US011477573B2

(12) United States Patent
Yu et al.

(10) Patent No.: US 11,477,573 B2
(45) Date of Patent: Oct. 18, 2022

(54) HANDHELD ELECTRONIC DEVICE WITH MULTIPLE SPEAKERS

(71) Applicant: ASUSTEK COMPUTER INC., Taipei (TW)

(72) Inventors: Tsung-Yen Yu, Taipei (TW); Kuo-Yuan Huang, Taipei (TW); Shih-Jie Kuo, Taipei (TW); Yuan-Hao Lo, Taipei (TW); Yen-Ming Chen, Taipei (TW); Wei-Chi Pan, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/324,766

(22) Filed: May 19, 2021

(65) Prior Publication Data

US 2021/0368266 A1 Nov. 25, 2021

(30) Foreign Application Priority Data

May 19, 2020 (TW) ..... 109116492

(51) Int. Cl.
*H04R 3/04* (2006.01)
*H04R 5/04* (2006.01)

(52) U.S. Cl.
CPC ..... *H04R 3/04* (2013.01); *H04R 5/04* (2013.01)

(58) Field of Classification Search
None
See application file for complete search history.

(56) References Cited

U.S. PATENT DOCUMENTS 8,005,233 B2 8/2011 Smith
10,382,857 B1 * 8/2019 Khanal ..... H04R 5/04
10,499,153 B1 * 12/2019 Seldess ..... H04S 7/307

FOREIGN PATENT DOCUMENTS

CN 102780959 A 11/2012
CN 103369429 B 10/2013
(Continued)

OTHER PUBLICATIONS

"AAC Technologies Highlights Innovative Next Generation Solutions For Mobile Devices and More at MWC19." AAC Technologies, Feb. 26, 2019, www.aactechnologies.com/en/index.php?m=content&c=index&a=show&catid=54&id=281. (Year: 2019).*
(Continued)

*Primary Examiner* — James K Mooney
(74) *Attorney, Agent, or Firm* — Muncy, Geissler, Olds & Lowe, P.C.

(57) ABSTRACT

A handheld electronic device includes a first speaker, a second speaker, and an audio controller. The audio controller includes a signal receiving unit, a frequency crossover unit, a harmonic-wave generating unit, a low frequency enhancement unit, and a signal synthesis unit. The signal receiving unit receives an original sound signal and generates a first channel signal and a second channel signal according to the original sound signal. The frequency crossover unit sets a preset frequency crossover point to filter the first channel signal to generate a low frequency signal. The harmonic-wave generating unit generates harmonic waves according to the low frequency signal. The low frequency enhancement unit generates an enhancing low-frequency signal according to the harmonic waves. The signal synthesis unit generates a first channel enhanced signal according to the enhancing low-frequency signal and drives the first speaker.

10 Claims, 5 Drawing Sheets

(56) References Cited

FOREIGN PATENT DOCUMENTS

| | | | |
|---|---|---|---|
| CN | 107786923 | A | 3/2018 |
| CN | 209249717 | U | 8/2019 |
| TW | 200944040 | A | 10/2009 |
| TW | 201926321 | A | 7/2019 |

OTHER PUBLICATIONS

Office Action issued in corresponding TW application No. 109116492 dated Jun. 22, 2021 (6 pages).

* cited by examiner

HANDHELD ELECTRONIC DEVICE WITH MULTIPLE SPEAKERS

CROSS-REFERENCE TO RELATED APPLICATION

This application claims the priority benefit of Taiwan applications serial No. 109116492, filed on May 19, 2020. The entirety of the above-mentioned patent application is hereby incorporated by reference herein and made a part of specification.

BACKGROUND OF THE INVENTION

Field of the Invention

The disclosure relates to a handheld electronic device and, more particularly, to a handheld electronic device with multiple speakers.

Description of the Related Art

Traditional handheld electronic devices, such as a smart phone, includes disadvantage of sound quality by its limited internal space. For example, in order to achieve two-channel balance and match the sound field when playing movies, it sacrifices the sound quality of the lower speakers to match the upper speakers with poor conditions that impacts the overall sound quality.

BRIEF SUMMARY OF THE INVENTION

A handheld electronic device is provided, which includes a first speaker, a second speaker, a casing, and an audio controller. The casing includes a first space and a second space to accommodate the first speaker and the second speaker, respectively. The audio controller is disposed in the casing and includes a signal receiving unit, a frequency crossover unit, a harmonic-wave generating unit, a low frequency enhancement unit, and a signal synthesis unit.

The signal receiving unit receives an original sound signal and generates a first channel signal and a second channel signal according to the original sound signal. The frequency crossover unit sets a preset frequency crossover point to filter the first channel signal to generate a low frequency signal. The harmonic-wave generating unit generates harmonic waves according to the low frequency signal.

The low frequency enhancement unit uses the harmonic waves to generate an enhancing low-frequency signal. The signal synthesis unit generates a first channel enhanced signal according to the enhancing low-frequency signal. The first channel enhanced signal is configured to drive the first speaker, and the second channel signal is configured to drive the second speaker.

The handheld electronic device provided in the embodiments improves the sound effect of the first speaker installed in the first space by strengthening the low frequency part of the first channel signal, and eliminate the structural limitation of the first speaker due to the lack of the head space, thus to balance the two-channel and improve the overall sound quality.

DETAILED DESCRIPTION OF THE EMBODIMENTS

The specific implementation will be described in more detail below with the schematic diagrams. According to the following description and the claims, the advantages and features will be clearer. It should be noted that the drawings are in a very simplified form and all use imprecise proportions, which are only used to conveniently and clearly assist in explaining the purpose of the embodiments.

Figure 1:
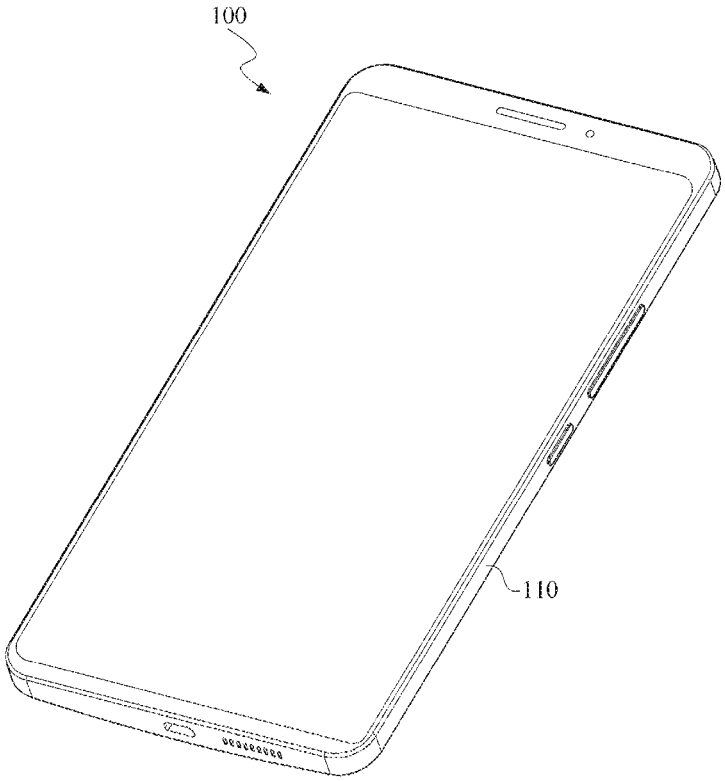
FIG. 1 is a schematic diagram of the appearance of a handheld electronic device in an embodiment.
Figure 2:
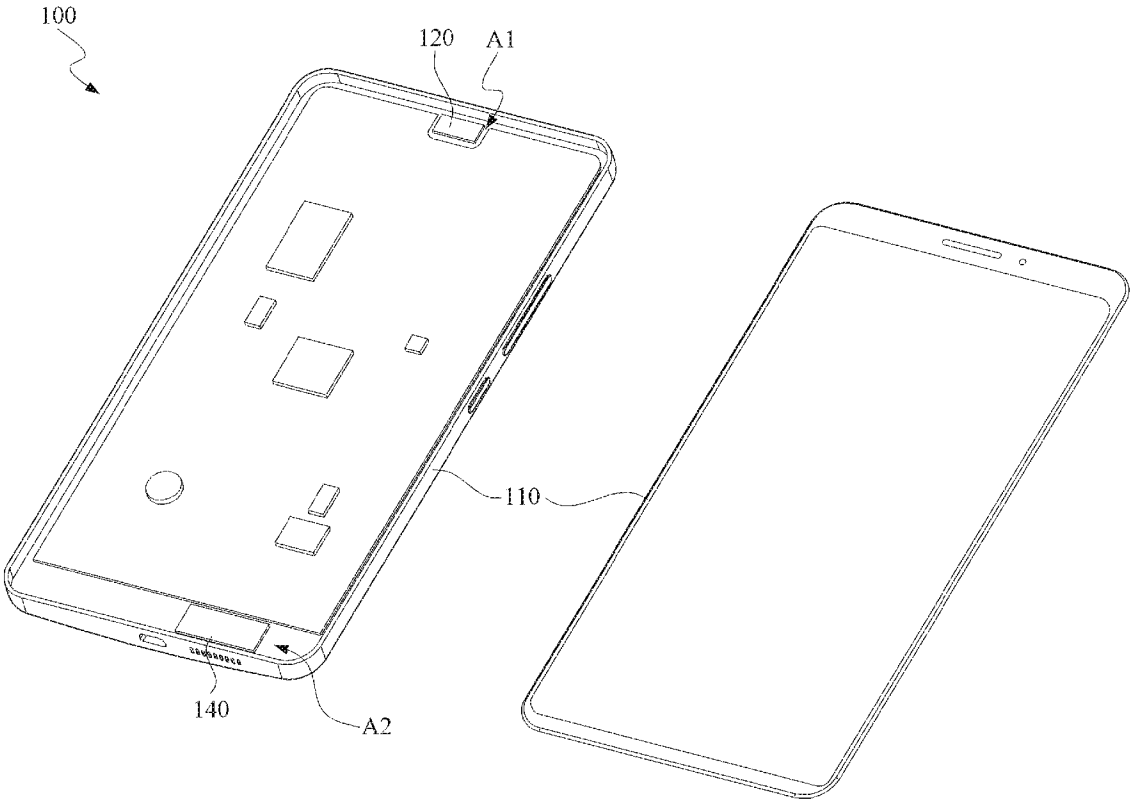
FIG. 2 is a schematic diagram of the internal space of the handheld electronic device of FIG. 1.

FIG. 1 is a schematic diagram of the appearance of a handheld electronic device in an embodiment. FIG. 2 is a schematic diagram of the internal space of the handheld electronic device of FIG. 1. The handheld electronic device 100 is a mobile phone, a tablet computer, or the handheld electronic devices with multiple speakers that provide multi-channel sound effects.

Figure 3:
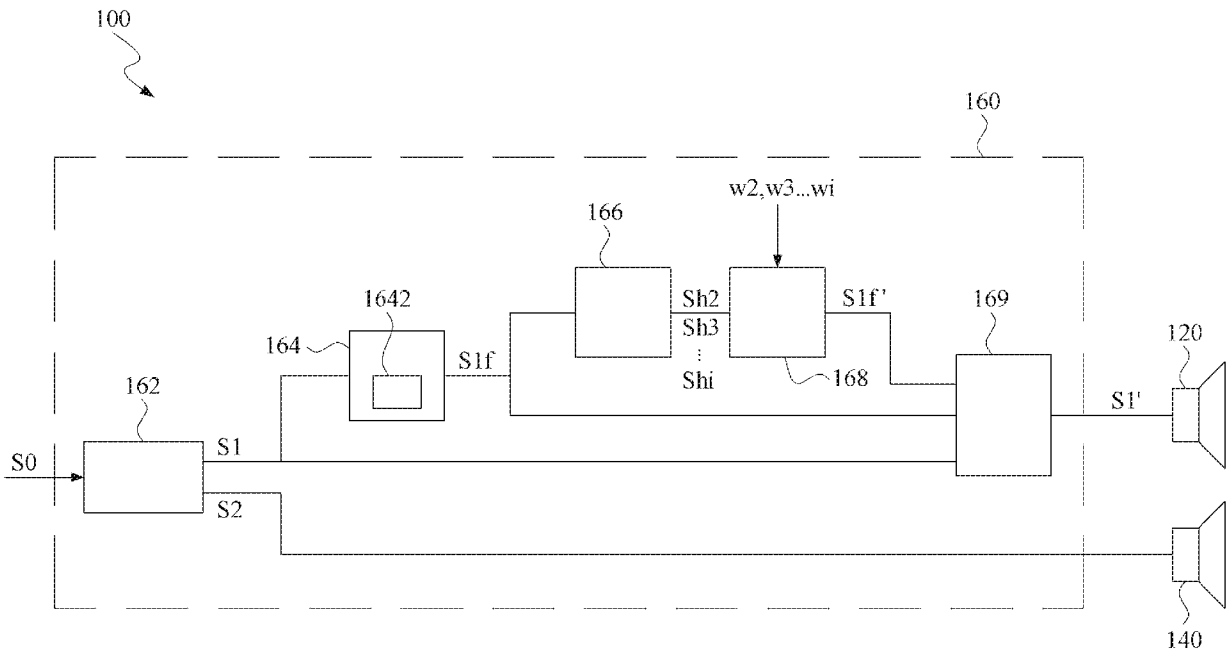
FIG. 3 is a block diagram of the handheld electronic device of FIG. 1 in an embodiment.

The handheld electronic device 100 includes a first speaker 120, a second speaker 140, and an audio controller 160 (showed in FIG. 3). The casing 110 of the handheld electronic device 100 includes a first space A1 and a second space A2 to accommodate the first speaker 120 and the second speaker 140, respectively. The second space A2 is larger than the first space A1. Therefore, the second space A2 accommodates larger speakers.

Normally when users operate a handheld electronic device 100 in a portrait mode, the available space at the bottom of the handheld electronic device 100 is usually greater than the available space at the top. In an embodiment, the first space A1 is the top space and the second space A2 is the bottom space.

In one embodiment, the maximum excursion of the second speaker 140 is greater than the maximum excursion of the first speaker 120. In one embodiment, the difference between the maximum excursion of the second speaker 140 and the first speaker 120 is greater than or equal to 0.1 mm.

In one embodiment, the first speaker 120 is a high-power receiver, and the second speaker 140 is a traditional amplitude speaker. In one embodiment, the first speaker 120 is a traditional amplitude speaker, and the second speaker 140 is a super linear speaker. In one embodiment, the first speaker 120 is a front speaker (that is, the sound is emitted toward the user), and the second speaker 140 is a side speaker (that is, the sound is emitted toward the bottom of the handheld electronic device), which is not limited herein. In another embodiment, the second speaker 140 is also a front speaker.

Please also refer to FIG. 3, FIG. 3 is a block diagram of the handheld electronic device of FIG. 1 in an embodiment. The audio controller 160 is disposed in the casing 110 and electrically connects the first speaker 120 and the second speaker 140.

The audio controller 160 includes a signal receiving unit 162, a frequency crossover unit 164, a harmonic-wave generating unit 166, a low frequency enhancement unit 168, and a signal synthesis unit 169. In one embodiment, the audio controller 160 is an independent audio controller chip. In an embodiment, the audio controller 160 is a part of circuit in the control chip. In one embodiment, the audio controller 160 is a hardware or a combination of hardware and software.

Wherein, the signal receiving unit 162 receives an original sound signal 50, and generates a first channel signal S1 and a second channel signal S2 according to the original sound signal 50. In an embodiment, the original sound signal 50 comes from a in coming call sound, music files played by a built-in music player of the handheld electronic device, and video files played by a built-in video player of the handheld electronic device. In one embodiment, the original sound signal 50 is a two-channel signal, and the first channel signal S1 and the second channel signal S2 are the left channel signal and the right channel signal, respectively.

The frequency crossover unit 164 receives the first channel signal S1 and includes a preset frequency crossover point for filtering the first channel signal S1 to generate a low frequency signal Slf. In one embodiment, the preset frequency crossover point is 750~850 Hz. The position of the preset frequency crossover point is adjusted according to the structural characteristics of the first speaker 120.

In one embodiment, the frequency crossover unit 164 includes a low pass filter 1642 for filtering the first channel signal S1 according to the preset frequency crossover point to generate the low frequency signal Slf.

The harmonic-wave generating unit 166 uses the low frequency signal Slf to generate a plurality of harmonic waves Sh2, Sh3 . . . Shi, wherein i represents the order of the harmonic waves. In one embodiment, these harmonic waves Sh2, Sh3 . . . Shi are integer harmonic waves of the low frequency signal Slf.

The low frequency enhancement unit 168 uses these harmonic waves Sh2, Sh3 . . . Shi to generate an enhancing low-frequency signal Slf'. In one embodiment, the low frequency enhancement unit 168 uses a plurality of preset harmonic weight values w2, w3 . . . wi corresponding to the harmonic waves Sh2, Sh3 . . . Shi to weight the harmonic waves Sh2, Sh3 . . . Shi and generates the enhancing low-frequency signal Slf'.

The order and the number of the harmonic waves that generated by the harmonic-wave generating unit 166 and the values of the preset harmonic weight values w2, w3 . . . wi depends on the structural characteristics of the first speaker 120 and the sound balance between the first speaker 120 and the second speaker 140. In one embodiment, the low frequency enhancement unit 168 uses the second to eighth order of the harmonic waves of the low frequency signal Slf to generate the enhancing low-frequency signal Slf', and the preset harmonic weight values corresponding to the harmonic waves are less than 0.6.

In the foregoing embodiment, the low frequency enhancement unit 168 uses the value that above the second order of the harmonic waves Sh2, Sh3 . . . Shi to generate the enhancing low-frequency signal Slf', instead of using the original low frequency signal Slf (the low frequency signal Slf is the fundamental wave, or called the first harmonic wave), which is not limited herein.

In one embodiment, the low frequency enhancement unit 168 also incorporates the first harmonic wave and assigns the corresponding harmonic weight value to it to generate the enhancing low-frequency signal Slf' that suitable for the structural characteristics of the first speaker 120.

The signal synthesis unit 169 uses the enhancing low-frequency signal Slf' to replace the original low frequency signal Slf to generate a first channel enhanced signal S1'. In one embodiment, the signal synthesis unit 169 performs subtraction processing on the first channel signal S1 and the low frequency signal Slf, and adds the processed signal (S1-Slf) and the enhancing low-frequency signal SW to generate the first channel enhanced signal S1'. The first channel enhanced signal S1' after low frequency enhancement is used to drive the first speaker 120, and the second channel signal S2 is used to drive the second speaker 140.

In the embodiment of FIG. 3, the signal synthesis unit 169 performs subtraction processing on the first channel signal S1 and the low frequency signal Slf, and adds the processed signal to the enhancing low-frequency signal Slf' to generate the first channel enhanced signal S1', which is not limited herein.

Figure 4:
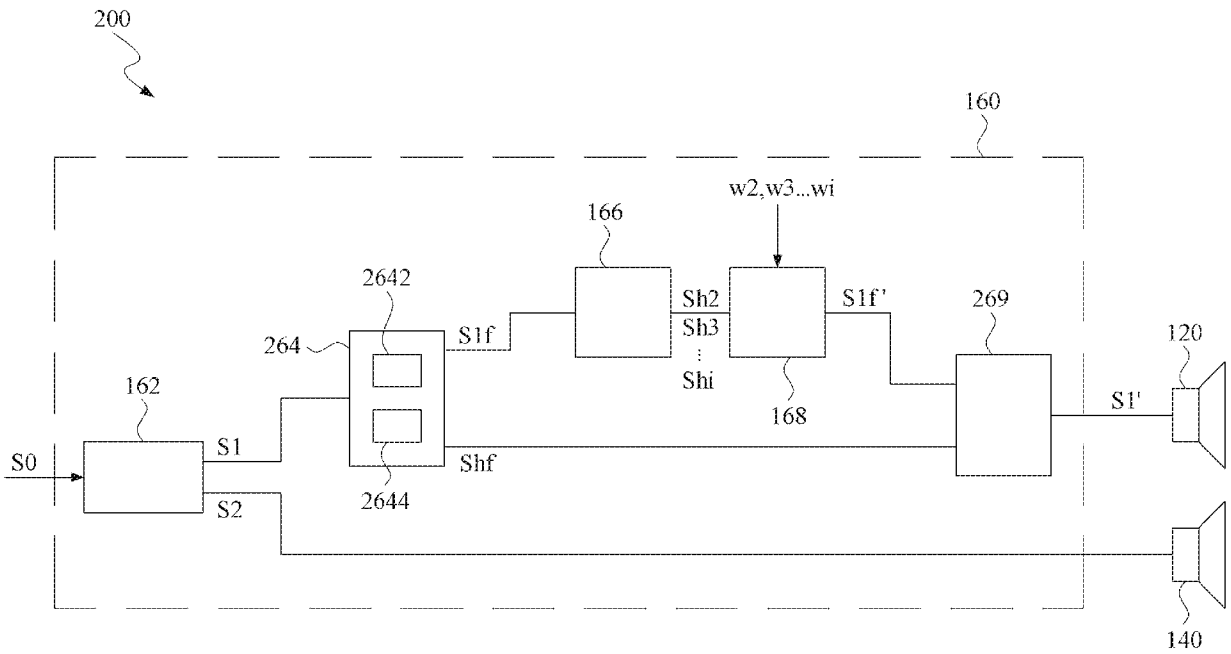
FIG. 4 is a block diagram of a handheld electronic device in another embodiment.

Please refer to FIG. 4. FIG. 4 is a block diagram of a handheld electronic device 200 in another embodiment. In one embodiment, the frequency crossover unit 264 sets the preset frequency crossover point to divide the first channel signal S1 into a low frequency signal Slf and a high frequency signal Shf. In an embodiment, the frequency crossover unit 264 includes a low pass filter 2642 and a high pass filter 2644, used to filter the first channel signal S1 according to the preset frequency crossover point to generate the low frequency signal Slf and the high frequency signal Shf. The subsequent enhancement processing of the low frequency signal Slf is the same as the embodiment of FIG. 3.

After the low frequency enhancement unit 168 generates the enhancing low-frequency signal Slf', the signal synthesis unit 269 in this embodiment combines the high frequency signal Shf and the enhancing low-frequency signal Slf' to generate the first channel enhanced signal S1', without subtracting the first channel signal S1 and the low frequency signal Slf.

Figure 5:
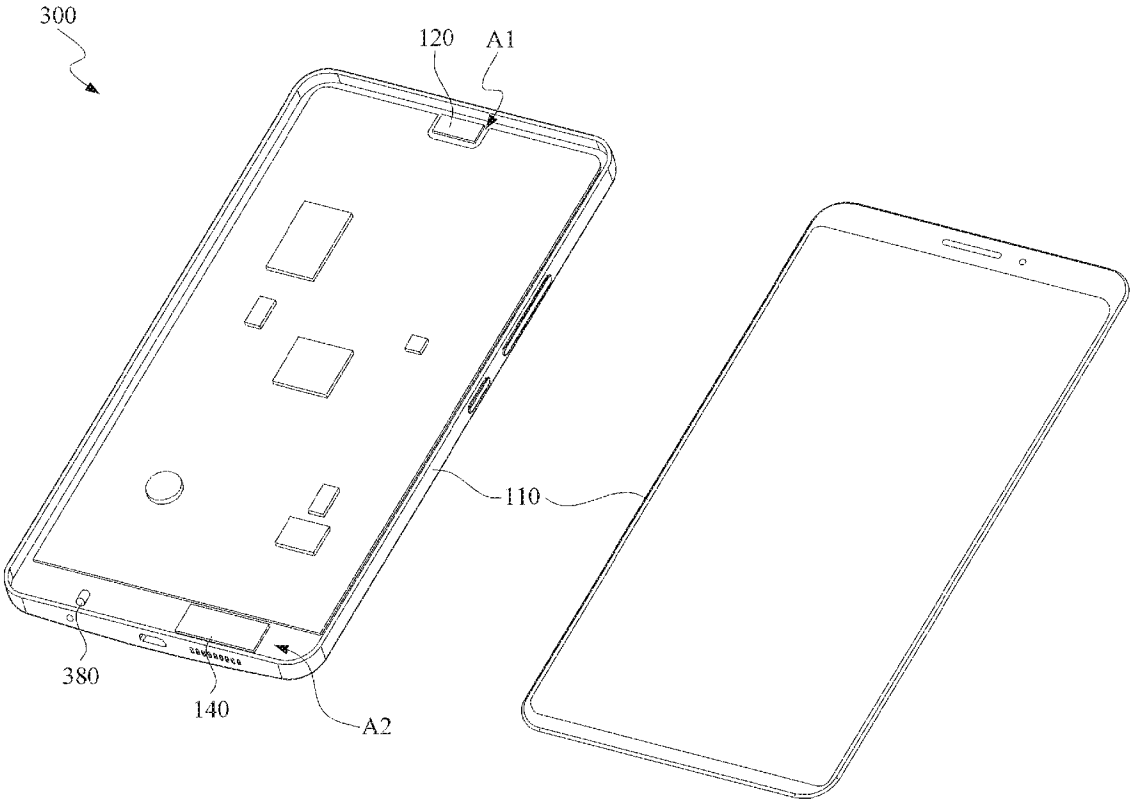
FIG. 5 is a schematic diagram of the internal space of a handheld electronic device in another embodiment.

FIG. 5 is a schematic diagram of the internal space of a handheld electronic device in another embodiment. The handheld electronic device 300 in this embodiment is a mobile phone. Compared with the embodiment of FIG. 2, the handheld electronic device 300 of this embodiment further includes a microphone 380.

The microphone 380 is located in the second space A2 of the casing 110 to receive users' voice, convert the received external voice into an input signal, and send it to the audio controller 160 for subsequent processing. For example, the input signal is converted into a sound file for storage, or transmitted to other callers via a wireless network.

The handheld electronic device 100, 200, 300 provided in the embodiments improves the sound effect of the first speaker 120 disposed in the head space by strengthening the low frequency part of the first channel signal S1, and solves the limitation of the structural characteristics of the first speaker 120 due to the lack of head space, to achieve the two-channel balance and improve the overall sound quality.

Although the present disclosure has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A handheld electronic device, comprising:

a first speaker;

a second speaker;

a casing, comprising a first space and a second space configured to accommodate the first speaker and the second speaker, respectively; and an audio controller, comprising:

a signal receiving unit, receiving an original sound signal and generating a first channel signal and a second channel signal according to the original sound signal;

a frequency crossover unit, only receiving the first channel signal, and setting a preset frequency crossover point to filter the first channel signal to generate a low frequency signal;

a harmonic-wave generating unit, generating a plurality of harmonic waves according to the low frequency signal; and a low frequency enhancement unit, generating an enhancing low-frequency signal according to the harmonic waves; and a signal synthesis unit, generating a first channel enhanced signal according to the enhancing low-frequency signal, wherein, the first channel enhanced signal is configured to drive the first speaker, and the second channel signal is configured to drive the second speaker.

2. The handheld electronic device according to claim 1, wherein, a maximum excursion of the second speaker is greater than a maximum excursion of the first speaker.

3. The handheld electronic device according to claim 2, wherein, a difference between the maximum excursion of the second speaker and that of the first speaker is greater than or equal to 0.1 mm.

4. The handheld electronic device according to claim 1, wherein, the second speaker is a super linear speaker.

5. The handheld electronic device according to claim 1, wherein, the first speaker is a receiver.

6. The handheld electronic device according to claim 1, wherein, the preset frequency crossover point is 750~850 Hz.

7. The handheld electronic device according to claim 1, wherein, the frequency crossover unit includes a low pass filter for filtering the first channel signal according to the preset frequency crossover point to generate the low frequency signal.

8. The handheld electronic device according to claim 1, wherein, the harmonic waves are integer harmonic waves.

9. The handheld electronic device according to claim 1, wherein, the low frequency enhancement unit weights the harmonic waves based on a plurality of preset harmonic weight values corresponding to the harmonic waves to generate the enhancing low-frequency signal.

10. The handheld electronic device according to claim 1, wherein, the second space is greater than the first space.

* * * * *